US010102988B2

(12) United States Patent
Khojare et al.

(10) Patent No.: US 10,102,988 B2
(45) Date of Patent: Oct. 16, 2018

(54) LOCKING ARRANGEMENT FOR A PLURALITY OF TOGGLE SWITCHES

(71) Applicant: Appleton Grp LLC, Rosemont, IL (US)

(72) Inventors: Shailesh Y. Khojare, Amravati (IN); Rehanul Hasan, Waterloo (CA); Abdulkhadar F. Goravankoll, Pune (IN)

(73) Assignee: Appleton Grp LLC, Rosemont, IL (US)

( * ) Notice: Subject to any disclaimer, the term of this patent is extended or adjusted under 35 U.S.C. 154(b) by 0 days.

(21) Appl. No.: 15/459,829

(22) Filed: Mar. 15, 2017

(65) Prior Publication Data

US 2017/0345591 A1 Nov. 30, 2017

(30) Foreign Application Priority Data

May 30, 2016 (IN) ..... 201621018543

(51) Int. Cl.
*H01H 9/26* (2006.01)
*H01H 13/72* (2006.01)
(Continued)

(52) U.S. Cl.
CPC ..... *H01H 21/06* (2013.01)

(58) Field of Classification Search
CPC ..... H01H 21/06; H01H 2003/00; H01H 2003/002; H01H 2003/02; H01H 2003/08; H01H 2003/10; H01H 2003/32; H01H 2003/46; H01H 2009/2026; H01H 2221/00; H01H 2221/016; H01H 2221/008; H01H 2221/024; H01H 2221/03; H01H 27/00; H01H 27/10; H01H 71/02; H01H 71/0207; H01H 71/10; H01H 71/1054; H01H 71/1072; H01H 71/128; H01H 71/46;
(Continued)

(56) References Cited

U.S. PATENT DOCUMENTS 2,506,187 A 5/1950 Yarrick
2,937,248 A 5/1960 Michetti
(Continued)

FOREIGN PATENT DOCUMENTS

EP 0 824 263 A2 2/1998

OTHER PUBLICATIONS

A Working Manual on Molded Case Circuit Breakers (2006) Westinghouse Electric Company LLC, pp. 1-33.
(Continued)

*Primary Examiner* — Anthony R. Jimenez
(74) *Attorney, Agent, or Firm* — McDonnell Boehnen Hulbert & Berhoff LLP

(57) ABSTRACT

A locking arrangement for a plurality of toggle switches is provided, which facilitates independent locking and independent actuation of the toggle switches. The locking arrangement restricts the movement of a lever associated with a toggle switch of the plurality of toggle switches so as to maintain the lever of the toggle switch in at least one predetermined position. The locking arrangement is adapted to receive a locking device that restricts the movement of the lever in at least one predetermined position defined by the periphery of a locking plate or a base plate of the locking arrangement.

8 Claims, 9 Drawing Sheets

(51) Int. Cl.
*H01H 13/76* (2006.01)
*H01H 21/06* (2006.01)

(58) Field of Classification Search
CPC ..... H01H 71/50; H01H 71/52; H01H 71/526; H01H 71/527; H01H 71/528; H01H 71/56; H01H 3/00; H01H 3/06; H01H 9/20; H01H 9/24; H01H 9/26; H01H 3/02; H01H 3/04; H01H 3/32; H01H 3/34; H01H 3/46; B60Q 1/42
USPC ..... 200/5 A, 61.35
See application file for complete search history.

(56) References Cited

U.S. PATENT DOCUMENTS 3,329,912 A 7/1967 Brackett
4,336,516 A 6/1982 Bratkowski et al.
4,924,041 A * 5/1990 Yee ..... H01H 9/26 200/50.33
5,349,145 A * 9/1994 Kelaita, Jr. ..... H01H 9/281 200/318
6,617,532 B1 9/2003 Turek
6,696,651 B1 2/2004 Koopmeiners et al.
7,145,089 B2 * 12/2006 Bogdon ..... H01H 9/26 200/43.01
7,355,133 B2 * 4/2008 McCoy ..... H01H 9/283 200/332.2
8,223,475 B2 7/2012 Baird et al.
8,508,917 B2 8/2013 Rus et al.
8,593,791 B2 11/2013 Baird et al.
8,748,759 B2 6/2014 Howard

OTHER PUBLICATIONS

Technical Data for AB DE-Jon Circuit Breakers (1990) Siemens Energy & Automation, pp. 1-56.

* cited by examiner

LOCKING ARRANGEMENT FOR A PLURALITY OF TOGGLE SWITCHES

FIELD

The present disclosure relates to the field of mechanical engineering, particularly to the field of locking arrangements for toggle switches.

BACKGROUND

Electrically powered machines are isolated from a power supply before performing adjustments, maintenance, or repair work of the machine by a human operator. Such isolation is required in order to prevent any accidental connection of the machine with the power supply unit. Similarly, the electrically powered machines are also required to always stay operational under normal working conditions. A down time of as low as a few minutes can have severe effects on other dependent processes and machines. Therefore, it is necessary to have a locking mechanism associated with circuit breakers in order to avoid unauthorized start and stop of the electrically powered machines.

Conventionally, a single common locking arrangement is used to provide lock to the levers of the toggle switches. The toggle switches are configured to control the ON and OFF operation of the circuit breakers. Therefore, locking or restricting the movement of the toggle switches, locks the circuit breaker in a predetermined position that is either ON or OFF. The disadvantage of such conventional locking arrangement is that it provides unwanted access to the switches, other than those toggle switches which need to be accessed, thereby increasing the chances of an accidental ON or OFF of the other toggle switches. Therefore, there is felt a need for a locking apparatus for toggle switches that can facilitate independent locking and independent actuation of each toggle switch from a plurality of toggle switches.

Definitions

Enclosure: The term "enclosure" hereinafter in the complete specification refers to an electrical housing body.

Panel: The term "panel" hereinafter in the complete specification refers to an electrical housing cover that is disposed on the top portion of the electrical housing body.

Objects

Some of the objects of the present disclosure, which at least one embodiment herein satisfies, are as follows.

It is an object of the present disclosure to mitigate one or more problems of the prior art or to at least provide a useful alternative.

An object of the present disclosure is to provide a locking arrangement for a plurality of toggle switches that provides individual actuation of each of the plurality of toggle switches.

Another object of the present disclosure is to provide a locking arrangement for a plurality of toggle switches that provides individual locking of each of the plurality of toggle switches.

Yet another object of the present disclosure is to provide a locking arrangement for a plurality of toggle switches that is easy to assemble.

Still another object of the present disclosure is to provide a locking arrangement for a plurality of toggle switches that is light in weight.

Still another object of the present disclosure is to provide a locking arrangement for a plurality of toggle switches that is cost effective.

Other objects and advantages of the present disclosure will be more apparent from the following description, which is not intended to limit the scope of the present disclosure.

SUMMARY

The present disclosure envisages a locking arrangement for a plurality of toggle switches. The locking arrangement is configured to facilitate independent locking and independent actuation of each toggle switch of the plurality of toggle switches.

In an embodiment, the locking arrangement includes, a locking plate and a panel. The locking plate is mountable on the panel. The locking plate includes, at least one opening configured on the locking plate for receiving a lever of at least one toggle switch of the plurality of toggle switches to facilitate the movement of the lever within predetermined positions as defined by the periphery of the at least one opening. At least one flange extending from the periphery of the at least one opening. The at least one flange having a hole configured thereon for receiving a locking device and limiting the movement of the lever of the at least one toggle switch, thereby maintaining the lever of the at least one toggle switch in at least one of the predetermined positions.

In another embodiment, the locking arrangement includes a panel, a base plate, and at least one locking plate. The base plate is mounted on the panel. The base plate includes at least one slot that is configured for receiving a lever of at least one toggle switch of the plurality of toggle switches. The at least one slot facilitates the movement of the lever of the at least one toggle switch within predetermined positions as defined by the periphery of the at least one slot. The base place further includes a projection. The projection extends from the periphery of the base plate having at least one aperture configured thereon. Further, the at least one locking plate is hingeably mounted on the base plate. The locking plate includes, at least two openings configured on the at least one locking plate for receiving the lever of the at least one toggle switch. The at least two openings limit the movement of the lever of the at least one toggle switch within at least one opening of the at least two openings so as to maintain the lever of the at least one toggle switch in at least one of the predetermined positions. At least one flange extends from the periphery of the at least one opening. The at least one flange of the locking plate has a hole configured thereon. The hole configured on the flange registers with the at least one aperture of the projection of the base plate when the locking plate abuts with the base plate. Further, the hole of the locking plate and the at least one aperture of the base plate is adapted to receive a locking device.

In yet another embodiment, the locking arrangement includes a panel and a locking plate. The locking plate is mounted on the panel. The locking plate includes, at least one opening configured on the locking plate. The at least one opening on the locking plate is adapted to receive a lever of at least one toggle switch of the plurality of toggle switches. The at least one opening facilitates the movement of the lever within predetermined positions as defined by the periphery of the at least one opening. The lever of at least one toggle switch further includes a through-hole formed thereon. At least two flanges extend from opposite sides of the at least one opening. The at least two flanges have a hole configured thereon. The hole registers with the through-hole of the lever when the lever abuts the at least one flange for receiving a locking device and limiting the movement of the lever of the at least one toggle switch so as to maintain the lever in at least one of the predetermined positions.

In still another embodiment, the locking arrangement includes a panel, a base plate and a locking plate. The base plate is mounted on the panel. At least one slot is configured on the base plate for receiving a lever of the at least one toggle switch. The at least one slot facilitates the movement of the lever of the at least one toggle switch within predetermined positions as defined by the periphery of the at least one slot. The lever of the at least one toggle switch includes a through-hole formed thereon. A projection extends from the periphery of the base plate. The projection has at least two apertures configured thereon. Further, the locking plate includes at least one hole configured thereon. The at least one hole registers with the through-hole of the lever when the lever abuts the locking plate for receiving a locking device. The locking plate has a protrusion that snap fits with at least one aperture of the at least two apertures of the base plate.

In still another embodiment, the locking plate is made from a single sheet metal.

In still another embodiment, the locking device includes a lockout hasp and an at least one lock.

In still another embodiment, the locking plate is secured to the panel by means of fasteners, screws, or nuts and bolts.

In still another embodiment, the hole of the at least one flange has a shape selected from a group consisting of a circle, a square, a triangle, or a rectangle.

BRIEF DESCRIPTION OF ACCOMPANYING DRAWINGS

A locking arrangement for a plurality of toggle switches of the present disclosure will now be described with the help of the accompanying drawing, in which.

DETAILED DESCRIPTION

Conventionally, a single common locking arrangement s being used to lock the levers of toggle switches. The common locking arrangement locks all the levers simultaneously with a single locking device. The disadvantage of such conventional locking arrangement is that it provides unwanted access to the toggle switches, other than those toggle switches which needs to be accessed, thereby, increasing the chances of an accidental ON or OFF of the other toggle switches.

Figure 1A:
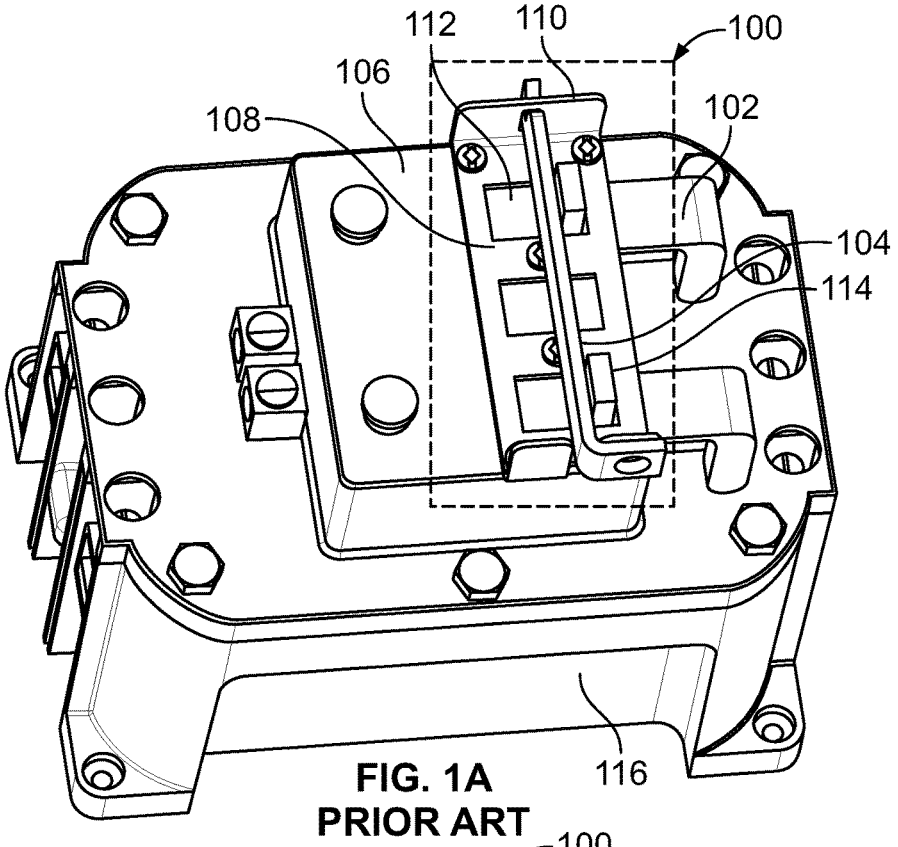
FIG. 1A PRIOR ART
FIG. 1A illustrates an isometric view of a conventional locking arrangement.
Figure 1B:
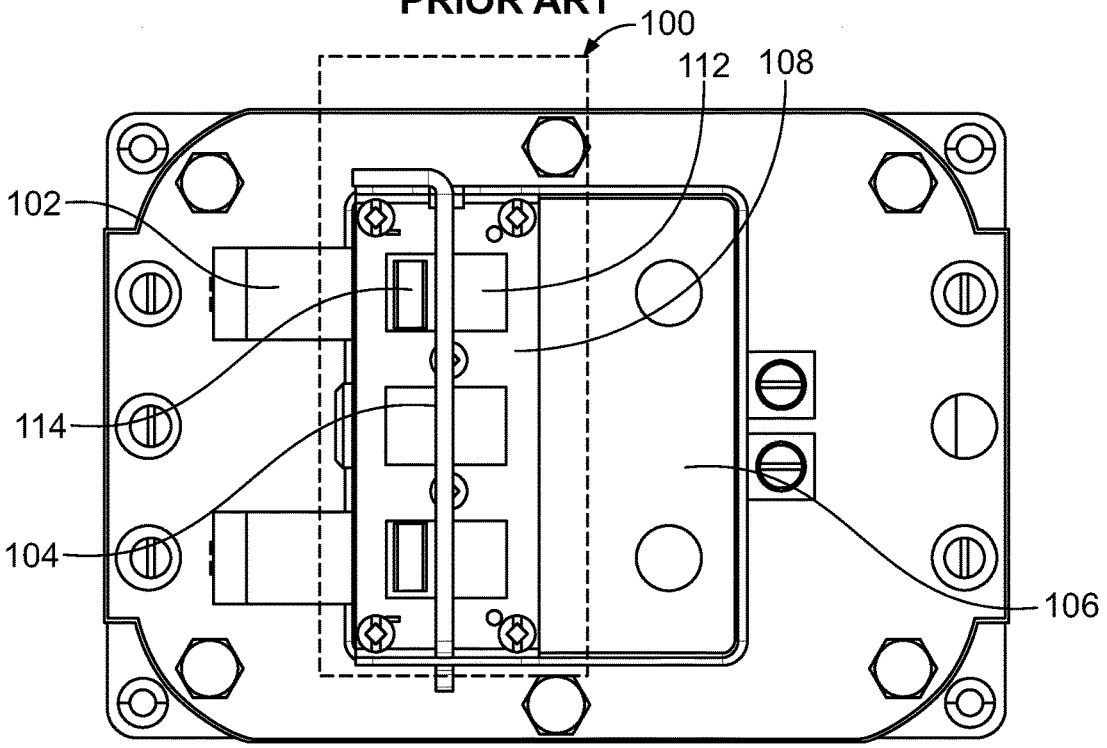
FIG. 1B PRIOR ART
FIG. 1B illustrates a top view of the conventional locking arrangement of FIG. 1A.
Figure 1C:
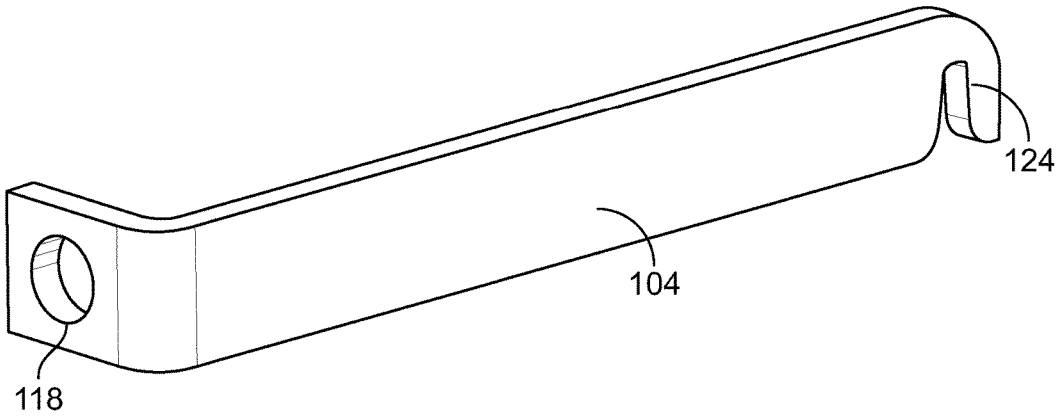
FIG. 1C PRIOR ART
FIG. 1C illustrates a schematic view of a locking rod of the conventional locking arrangement of FIG. 1A.
Figure 1D:
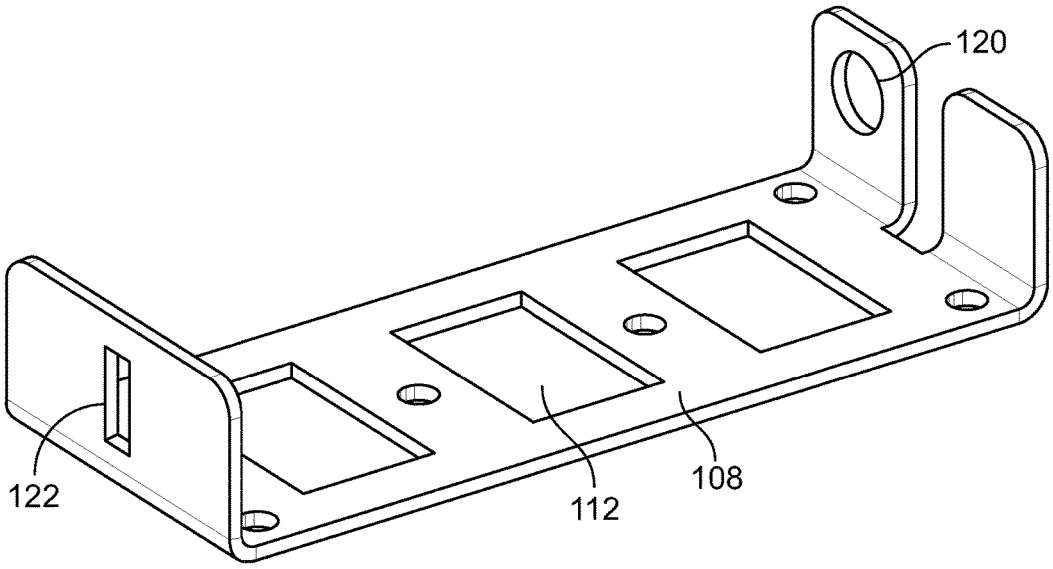
FIG. 1D PRIOR ART
FIG. 1D illustrates a schematic view of a locking plate of the conventional locking arrangement of FIG. 1A.

FIG. 1A illustrates an isometric view of a conventional locking arrangement. FIG. 1B illustrates a top view of the conventional locking arrangement of the FIG. 1A. FIG. 1C illustrates a schematic view of a locking rod of the conventional locking arrangement of FIG. 1A. FIG. 1D illustrates a schematic view of a locking plate of the conventional locking arrangement of FIG. 1A.

The conventional locking arrangement 100 comprises a lever 114 associated with one of a toggle switch of a plurality of toggle switches 102, a locking rod 104, a panel 106, a conventional locking plate 108, a plurality of flanges 110, a plurality of openings 112, and an enclosure 116. The enclosure 116 is a sealed electrical enclosure for use in hazardous locations for enclosing circuit breakers. The sealed enclosure comprises a top housing (not exclusively labelled in the FIGS. 1A-1D), a bottom housing (not exclusively labelled in the FIGS. 1A-1D). The panel 106 is disposed on top of the enclosure 116. The conventional locking plate 108 is mounted on the panel 106. The plurality of openings 112 is configured on the conventional locking plate 108 that is configured for receiving the lever 114 of at least one toggle switch of the plurality of toggle switches 102. The plurality of openings 112 facilitates the movement of the lever 114 of the plurality of toggle switches 102. The plurality of flanges 110 extends from the opposite edges of the conventional locking plate 108. A hole 120 is configured on at least one flange of the plurality of flanges 110 and an aperture 122 is configured on a flange opposite to the at least one flange that contains the hole 120. The locking rod 104 comprises two ends. A recess 124 is configured on one end of the locking rod 104 and a through-hole 118 is configured on a free end of the locking rod 104. The recess 124 facilitates the engagement of the one end of the locking rod 104 with the aperture 122 of the locking plate 104. The engagement and disengagement of the locking rod 104 divides the plurality of openings 112 into two equal parts, thereby restricting the movement of the lever 114 of the plurality of toggle switches 102 within predetermined positions. The through-hole 118 of the locking rod 104 registers with the hole 120 of the flange when the locking rod 104 abuts with the flange containing the hole 120, thereby receiving a locking device for locking the locking rod 104 with the conventional locking plate 108.

The present disclosure envisages a locking arrangement for a plurality of toggle switches. The locking arrangement is configured to facilitate independent locking and independent actuation of each toggle switch of the plurality of toggle switches.

Figure 2A:
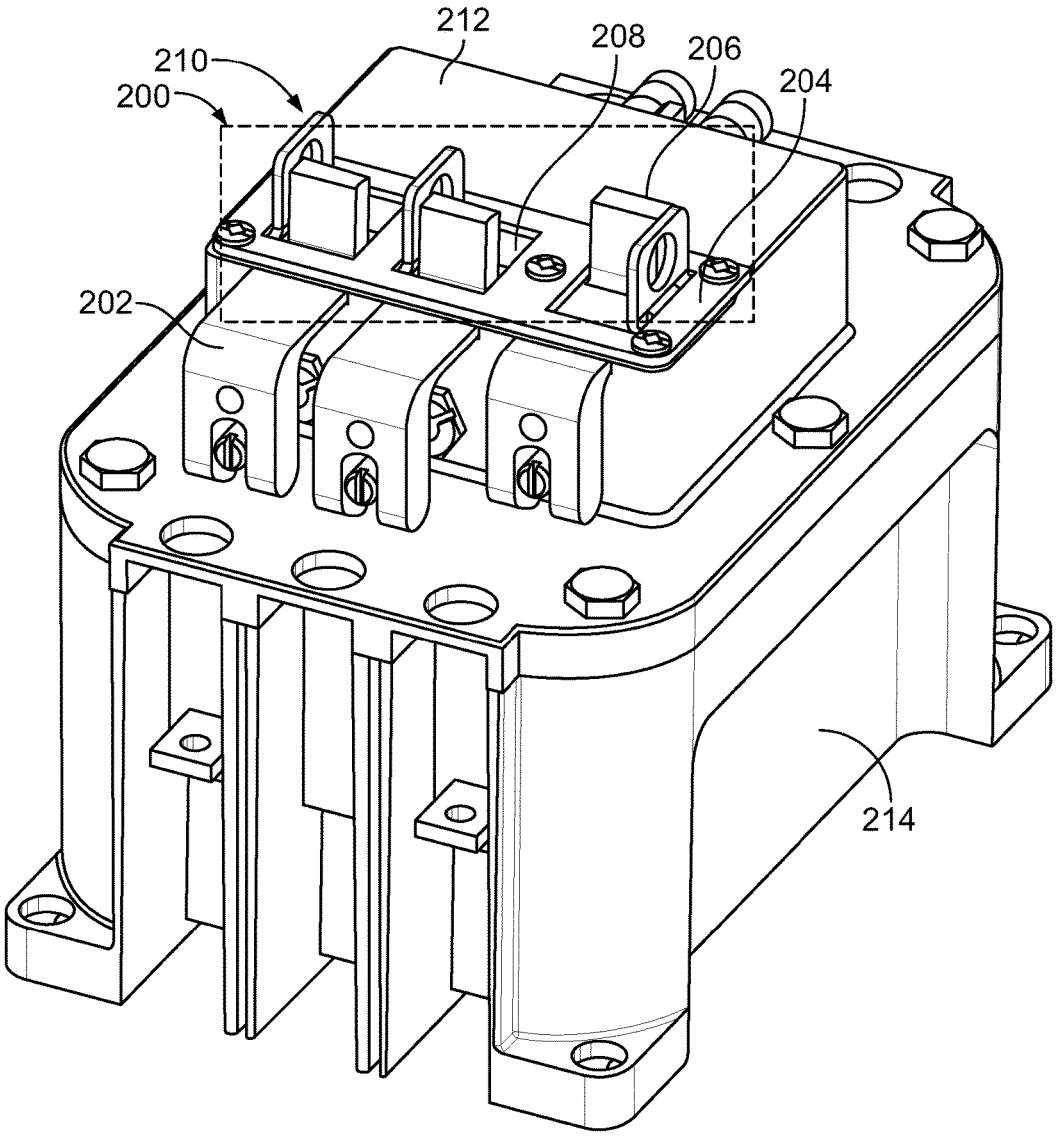
FIG. 2A illustrates an isometric view of a locking arrangement for toggle switches, in accordance with an embodiment of the present disclosure.
Figure 2B:
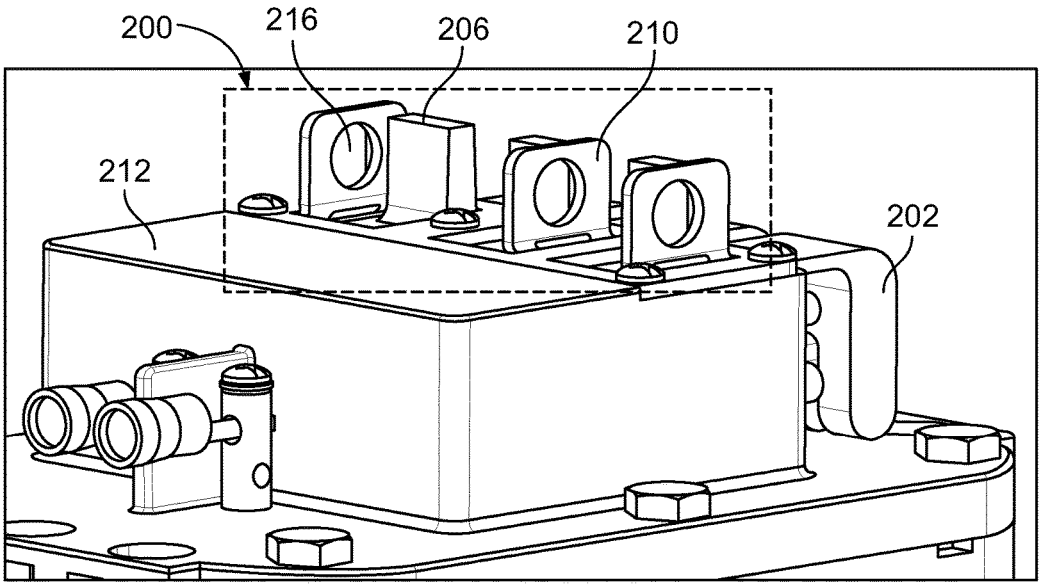
FIGS. 2B and 2C illustrate a different view of the locking arrangement of FIG. 2A.
Figure 2C:
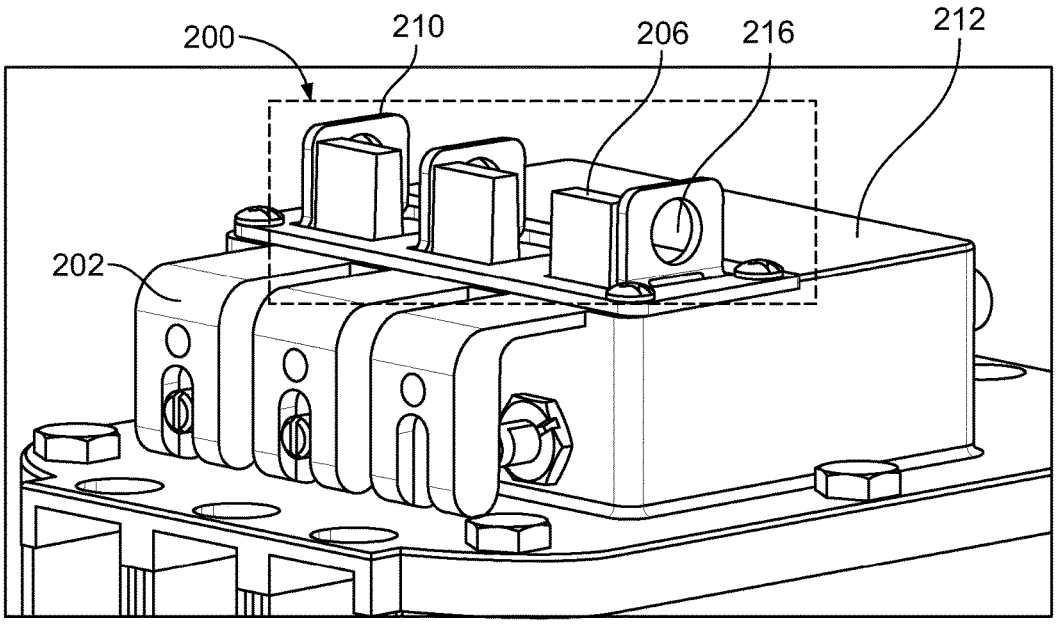
Figure 2D:
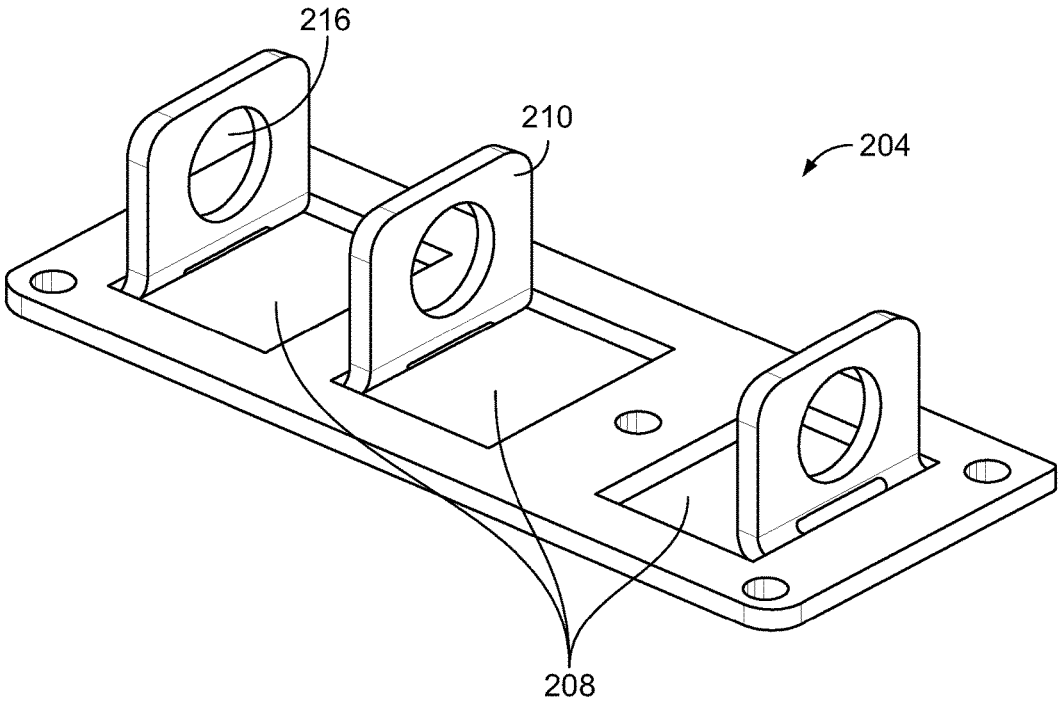
FIGS. 2D and 2E illustrate isometric views of a locking plate of the locking arrangements of FIGS. 2A-2C.
Figure 2E:
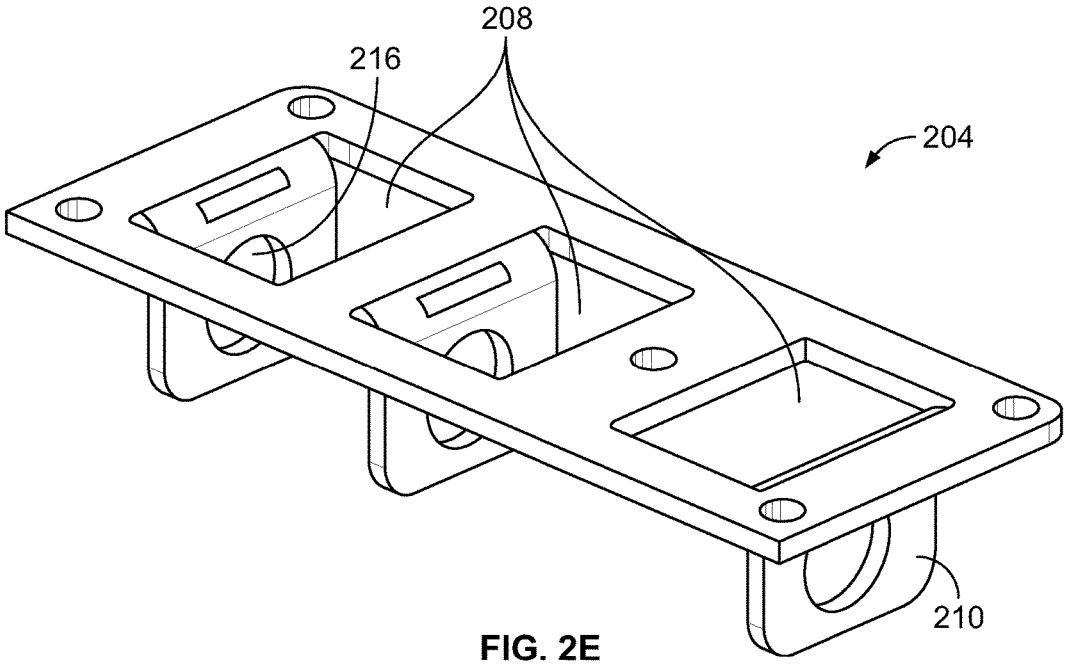

FIG. 2A illustrates an isometric view of a locking arrangement 200 for a plurality of toggle switches, in accordance with an embodiment of the present disclosure. FIGS. 2B and 2C illustrate different views of the locking arrangement 200 for a plurality of toggle switches. FIGS. 2D and 2E illustrate isometric views of a locking plate 204 of the locking arrangement 200.

The locking arrangement 200 includes, the locking plate 204 and a panel 212 of the enclosure 214. In an embodiment, the enclosure is a sealed electrical enclosure for enclosing circuit breakers. The enclosure includes a bottom housing (not exclusively labelled in the FIGS. 2*a*-2*e*) and a top housing (not exclusively labelled in the FIGS. 2*a*-2*e*). The panel 212 is mounted on an operative top surface of the top housing. The locking plate 204 is mounted on the panel 212. In an embodiment, the locking plate 204 is mounted on the panel 212 by means of fasteners, screws, or nuts and bolts. The locking plate 204 includes, at least one opening 208. The at least one opening 208 is configured for receiving a lever 206 of at least one toggle switch 202 of the plurality of toggle switches. The at least one opening 208 facilitates the movement of the lever 206 within predetermined positions as defined by the periphery of the at least one opening 208. At least one flange 210 extends from the periphery of the at least one opening 208. The at least one flange 210 has a hole 216 configured thereon for receiving a locking device (not shown in the figures). The locking device limits the movement of the lever 206 of the at least one toggle switch 202, thereby maintaining the lever 206 of the at least one toggle switch 202 in one of the predetermined positions. In an embodiment, the locking device includes a lockout hasp and at least one lock. In yet another embodiment, the locking plate 204 is made from a single sheet of metal. In still another embodiment, the hole 216 of the at least one flange 210 has a shape selected from the group consisting of a circle, a square, a triangle, and a rectangle.

Figure 3A:
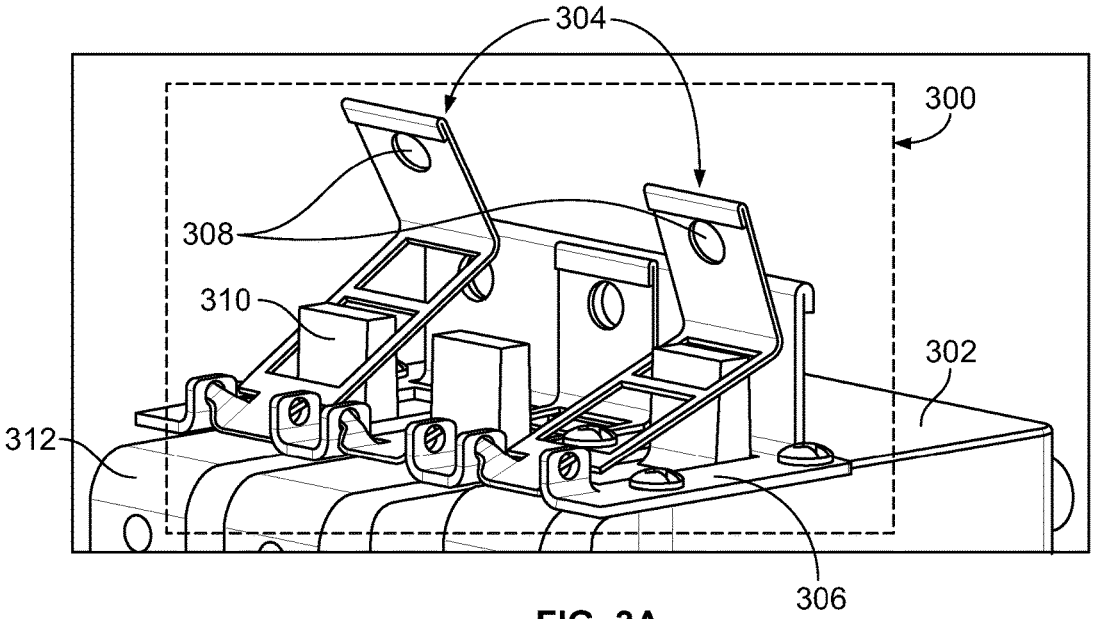
FIG. 3A illustrates an isometric view of a locking arrangement for toggle switches, in accordance with another embodiment of the present disclosure.
Figure 3B:
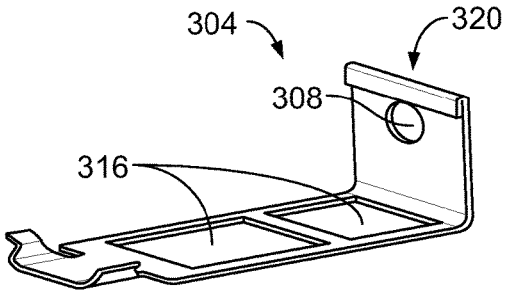
FIG. 3B illustrates an isometric view of a locking plate of the locking arrangement of FIG. 3A.
Figure 3C:
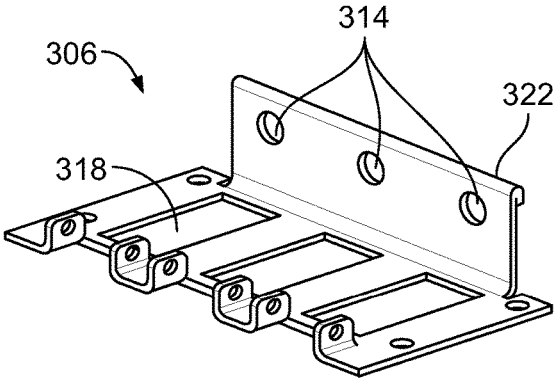
FIG. 3C illustrates an isometric view of a base plate of the locking arrangement of FIG. 3A.

FIG. 3A illustrates an isometric view of a locking arrangement 300 for a plurality of toggle switches, in accordance with another embodiment of the present disclosure. FIG. 3B illustrates an isometric view of at least one locking plate 304 of the locking arrangement 300. FIG. 3C illustrates an isometric view of a base plate 306 of the locking arrangement 300.

The locking arrangement 300 includes a panel 302, the base plate 306, and the at least one locking plate 304. The base plate 306 is mounted on the panel 302. In an embodiment, the base plate 306 is mounted on the panel 302 by means of fasteners, screws, or nuts and bolts. The base plate 306 includes at least one slot 318 configured for receiving a lever 310 of at least one toggle switch 312 of the plurality of toggle switches. The at least one slot 318 facilitates the movement of the lever 310 of the at least one toggle switch 312 within predetermined positions defined by the periphery of the at least one slot 318. The base place further includes, a projection 322. The projection 322 extends from the periphery of the base plate 306 and has at least one slot 318 configured thereon. A pair of through-holes is configured on the one end of the base plate 306. Still further, the at least one locking plate 304 is hingeably mounted on the base plate 306. In an embodiment, a pair of protrusions is configured on one end of the locking plate.

The pair of through-holes are adapted to receive a pair of protrusions, thereby providing a hinging mechanism between the at least one locking plate 304 and the base plate 306. The at least one locking plate 304 also includes, at least two openings 316 configured on the at least one locking plate 304 for receiving the lever 310 of the at least one toggle switch 312. The at least two openings 316 configured on the at least one locking plate 304 limit the movement of the lever 310 of the at least one toggle switch 312 within at least one opening of the at least two openings 316 so as to maintain the lever 310 of the at least one toggle switch 312 in one of the predetermined positions. Further, at least one flange 320 of the at least one locking plate 304 extends from the periphery of the at least one openings. The at least one flange 320 of the at least one locking plate 304 has a hole 308 configured thereon. The hole 308 configured on the at least one flange 320 registers with the at least one aperture 314 of the projection 322 of the base plate 306 when the at least one locking plate 304 abuts with the base plate 306. The hole 308 of the at least one locking plate 304 and the at least one aperture 314 of the base plate 306 is adapted to receive a locking device (not shown in the figure). In an embodiment, the locking device includes a lockout hasp and at least one lock. In another embodiment, the locking plate is made from a single sheet of metal. In still another embodiment, the hole 308 of the at least one flange 320 has a shape selected from the group consisting of a circle, a square, a triangle, and a rectangle.

Figure 4A:
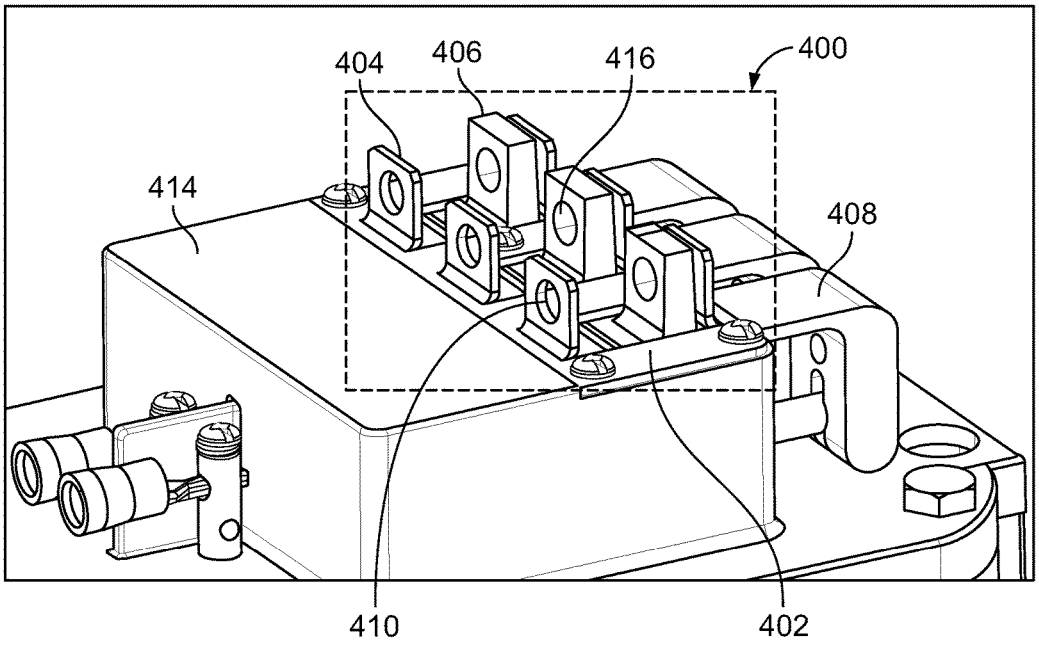
FIG. 4A illustrates an isometric view of a locking arrangement for toggle switches, in accordance with still another embodiment of the present disclosure.
Figure 4B:
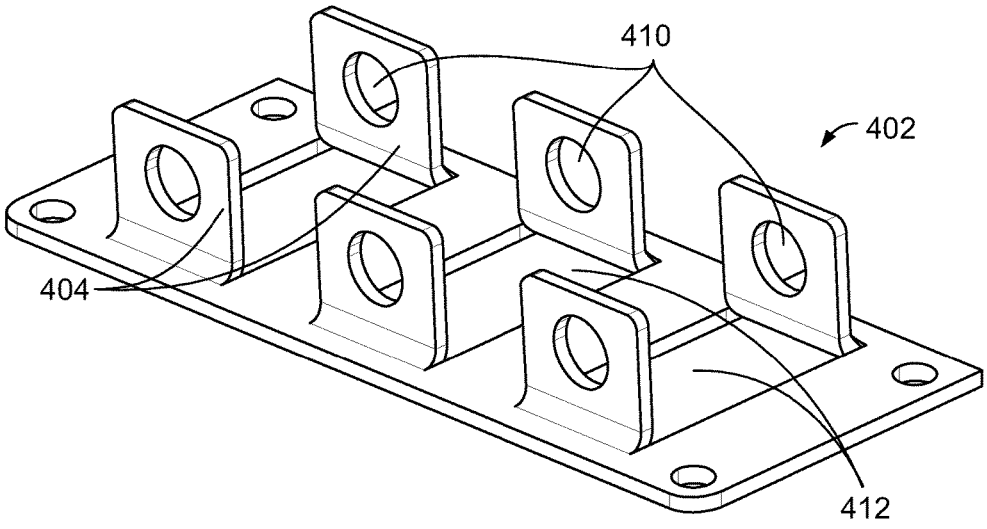
FIG. 4B illustrates an isometric view of a locking plate of the locking arrangement of FIG. 4A.

FIG. 4A illustrates an isometric view of a locking arrangement 400 for a plurality of toggle switches, in accordance with still another embodiment of the present disclosure. FIG. 4B illustrates an isometric view of a locking plate of the locking arrangement of FIG. 4A.

The locking arrangement 400 includes a panel 414 and a locking plate 402. The locking plate 402 is mounted on the panel 414. In an embodiment, the locking plate 402 is mounted on the panel 414 by means of fasteners, screws, or nuts and bolts. The locking plate 402 includes, at least one opening 412 configured on the locking plate 402. The at least one opening 412 on the locking plate 402 is adapted to receive a lever 406 of at least one toggle switch 408 of the plurality of toggle switches. The at least one opening 412 facilitates the movement of the lever 406 within predetermined positions as defined by the periphery of the at least one opening 412. The lever 406 of the at least one toggle switch 408 further includes a through-hole 416 formed thereon. At least two flanges 404 extend from opposite sides of the at least one opening 412. The at least two flanges 404 have a hole 410 configured thereon. The hole 410 registers with the through-hole 416 of the lever 406, when the lever 406 abuts the one flange of the at least two flanges 404 for receiving a locking device (not shown in the figures), thereby limiting the movement of the lever 406 of the at least one toggle switch 408 so as to maintain the lever 406 in at least one of the predetermined positions. In an embodiment, the locking plate is made from a single sheet of metal. In still another embodiment, the hole 410 of the at least two flanges 404 has a shape selected from the group consisting of a circle, a square, a triangle, and a rectangle.

Figure 5B:
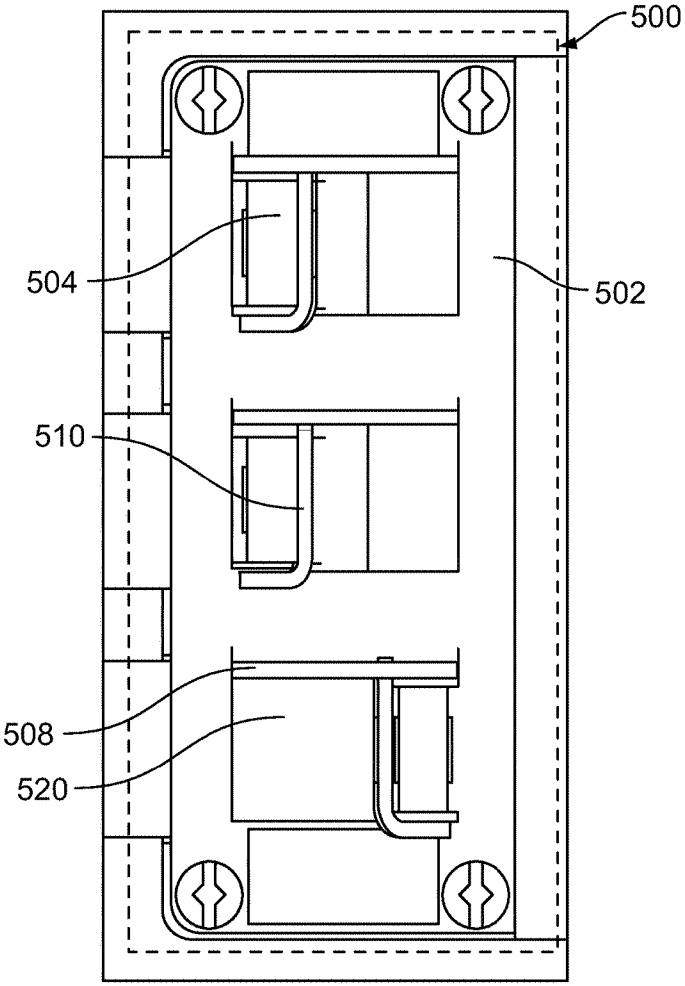
FIG. 5B illustrates a top view of the locking arrangement for toggle switches of the FIG. 5A.
Figure 5A:
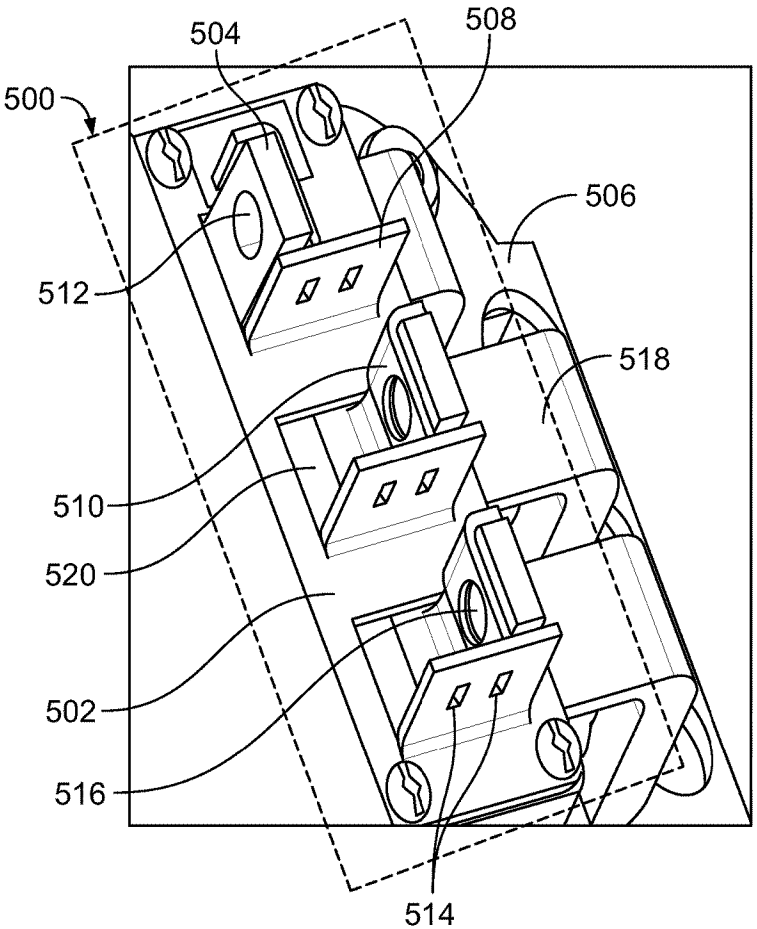
FIG. 5A illustrates a schematic view of a locking arrangement for toggle switches, in yet another accordance with an embodiment of the present disclosure.
Figure 5C:
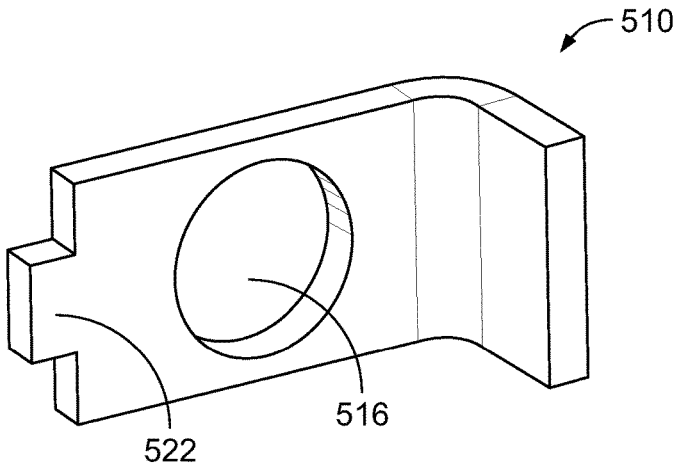
FIG. 5C illustrates an isometric view of a locking plate of the locking arrangement of FIGS. 5A and 5B.
Figure 5D:
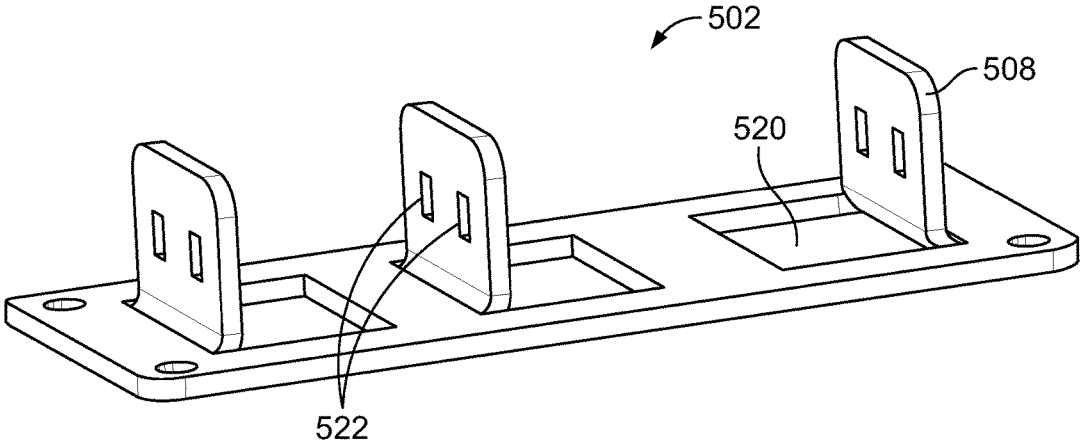
FIG. 5D illustrated an isometric view of a base plate of the locking arrangement of FIGS. 5A and 5B.

FIG. 5A illustrates a schematic view of a locking arrangement 500 for a plurality of toggle switches 518, in accordance with an embodiment of the present disclosure. FIG. 5B illustrates a top view of the locking arrangement 500 for the plurality of toggle switches 518 of the FIG. 5A. FIG. 5C illustrates an isometric view of a locking plate 510 of the locking arrangement 500 of FIGS. 5A and 5B. FIG. 5D illustrates an isometric view of a base plate 502 of the locking arrangement 500 of the FIGS. 5A and 5B.

The locking arrangement 500 includes a panel 506, the base plate 502 and the locking plate 510. The base plate 502 is mounted on the panel. In an embodiment, the base plate 502 is mounted on the panel 506 by means of fasteners, screws, or nuts and bolts. At least one slot 520 is configured on the base plate 502 for receiving a lever 504 of the at least one toggle switch 518. The at least one slot 520 facilitates the movement of the lever 504 of the at least one toggle switch 518 within predetermined positions as defined by the periphery of the at least one slot 520. The lever 504 of the at least one toggle switch includes a through-hole 512 formed thereon. A projection 508 extends from the periphery of the base plate 502. The projection 508 has at least two apertures 514 configured thereon. Further, the locking plate 510 includes at least one hole 516 configured thereon. The locking plate 510 has a protrusion 522 that snap fits with at least one aperture of the at least two apertures 514 of the base plate 502, thereby restricting the movement of the lever 504 of the at least one toggle switch 518. The at least one hole 516 registers with the through-hole 512 of the lever 504 when the lever 504 abuts the locking plate 510 for receiving a locking device (not shown in the figures). In another embodiment, the locking device includes a lockout hasp and at least one lock. In still another embodiment, the at least one hole 516 of the locking plate 510 has a shape selected from the group consisting of a circle, a square, a triangle, and a rectangle.

Technical Advances and Economical Significance

The present disclosure described herein above has several technical advantages including, but not limited to, the realization of a locking arrangement for a plurality of toggle switches that:

provides individual actuation of the toggle switches;
individual locking of the toggle switches;
is easy to assemble;
is light in weight; and
is cost effective.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

The use of the expression "at least" or "at least one" suggests the use of one or more elements or ingredients or quantities, as the use may be in the embodiment of the disclosure to achieve one or more of the desired objects or results.

Any discussion of documents, acts, materials, devices, articles or the like that has been included in this specification is solely for the purpose of providing a context for the disclosure. It is not to be taken as an admission that any or all of these matters form a part of the prior art base or were common general knowledge in the field relevant to the disclosure as it existed anywhere before the priority date of this application.

The numerical values mentioned for the various physical parameters, dimensions or quantities are only approximations and it is envisaged that the values higher/lower than the numerical values assigned to the parameters, dimensions or quantities fall within the scope of the disclosure, unless there is a statement in the specification specific to the contrary.

While considerable emphasis has been placed herein on the components and component parts of the preferred embodiments, it will be appreciated that many embodiments can be made and that many changes can be made in the preferred embodiments without departing from the principles of the disclosure. These and other changes in the preferred embodiment as well as other embodiments of the disclosure will be apparent to those skilled in the art from the disclosure herein, whereby it is to be distinctly understood that the foregoing descriptive matter is to be interpreted merely as illustrative of the disclosure and not as a limitation.

We claim:

1. A locking arrangement for a plurality of toggle switches, said locking arrangement being configured to facilitate independent locking and independent actuation of each toggle switch of said plurality of toggle switches; which includes a locking plate having:

i. at least one opening configured on said locking plate for receiving a lever of at least one toggle switch of the plurality of toggle switches to facilitate a movement of the lever between a first position and a second position as defined by a periphery of the at least one opening, and ii. at least one flange extending upwardly from the locking plate and positioned in a plane parallel to the movement of the lever, the at least one flange having a hole configured thereon for receiving a locking device and limiting the movement of the lever so as to maintain the lever in the first position when the lever is positioned on a first side of the hole, and limiting movement of the lever so as to maintain the lever in the second position when the lever is positioned on a second side of the hole that is positioned opposite of the first side of the hole, and a panel, wherein said locking plate is mountable on said panel; and wherein when a shank of a padlock is inserted into the hole on the flange, the shank of the padlock is in the way of the lever and the shank of the padlock prevents movement of the lever.

2. The locking apparatus as claimed in claim 1, wherein said locking plate is made from a single sheet of metal.

3. The locking apparatus as claimed in claim 1, wherein said locking apparatus includes a lockout hasp and at least one lock.

4. The locking apparatus as claimed in claim 1, wherein said locking plate is secured with said panel by means of fasteners, screws, or nuts and bolts.

5. A locking arrangement for a plurality of toggle switches, said locking arrangement being configured to facilitate independent locking and independent actuation of each toggle switch of said plurality of toggle switches, where the locking arrangement includes:

a panel;

a base plate, said base plate being mountable on said panel, said base plate comprising:

i. at least one slot configured on said base plate for receiving a lever of at least one toggle switch of said plurality of toggle switches to facilitate a movement of said lever of said at least one toggle switch within predetermined positions as defined by the periphery of said at least one slot, and ii. a projection extending from said base plate, said projection having at least one aperture configured thereon, and at least one locking plate being hingeably mounted on said base plate, said locking plate comprising:

i. first and second openings configured on said at least one locking plate for receiving said lever of said at least one toggle switch, and limiting the movement of said lever within the first opening so as to maintain said lever in a first position within the first opening, and limiting movement of said lever within the second opening so as to maintain said lever in a second position within the second opening, ii. at least one flange upwardly extending from the locking plate, said at least one flange having a hole configured thereon, said hole being registerable with said at least one aperture of said projection when said locking plate abuts said base plate; and iii. a locking device being receivable via said hole and said at least one aperture.

6. A locking arrangement for a plurality of toggle switches, said locking arrangement being configured to facilitate independent locking and independent actuation of each toggle switch of said plurality of toggle switches which includes:

a panel; and a locking plate mountable on said panel, said locking plate comprising:

i. at least one opening configured on said locking plate for receiving a lever of at least one toggle switch of said plurality of toggle switches to facilitate a movement of said lever within predetermined positions as defined by the periphery of said at least one opening, wherein said lever includes a through-hole formed thereon extending in a direction of movement of said lever, and ii. a first flange and a second flange upwardly extending from opposite sides of said at least one opening, said flanges extending in a direction perpendicular to the direction of movement of said lever, said first and second flanges each having a hole configured thereon, wherein said hole registers with said through-hole of said lever when said lever abuts said first or second flange for receiving a locking device and limiting the movement of said lever of said at least one toggle switch so as to maintain said lever in at least one of said predetermined positions.

7. The locking arrangement as claimed in claim 6, wherein said hole of said first and second flanges has a shape selected from a group consisting of a circle, a square, a triangle, a rectangle.

8. A locking arrangement for a plurality of toggle switches, said locking arrangement being configured to facilitate independent locking and independent actuation of each toggle switch of said plurality of toggle switches, where the locking arrangement includes:

a panel;

a base plate being mountable on said panel, said base plate comprising:

i. at least one slot configured on said base plate for receiving a lever of said at least one toggle switch, and facilitate the movement of said lever of said at least one toggle switch within predetermined positions as defined by the periphery of said at least one slot, wherein said lever includes a through-hole formed thereon; and ii. a projection extending from the periphery of said base plate, said projection having at least two apertures configured thereon;

a locking plate including at least one hole configured thereon which registers with said through-hole when said lever abuts said locking plate for receiving a locking device, said locking plate having a protrusion that snap fits with at least one aperture of said at least two apertures of said base plate.

* * * * *